US008701935B2

(12) United States Patent
Todokoro

(10) Patent No.: US 8,701,935 B2
(45) Date of Patent: Apr. 22, 2014

(54) WATER GUN

(71) Applicant: Agatsuma Co., Ltd., Tokyo (JP)

(72) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 0 days.

(21) Appl. No.: 13/718,561

(22) Filed: Dec. 18, 2012

(65) Prior Publication Data

US 2013/0153599 A1 Jun. 20, 2013

(30) Foreign Application Priority Data

Dec. 19, 2011 (JP) ..... 2011-276834

(51) Int. Cl.
*A63H 3/18* (2006.01)
*B67D 7/70* (2010.01)
*G01F 11/00* (2006.01)

(52) U.S. Cl.
USPC ..... 222/79; 222/275; 222/255; 222/372; 222/379; 446/473; 446/475

(58) Field of Classification Search
USPC ..... 222/79, 265, 275, 469, 252, 255, 278, 222/372, 379; 124/65, 69, 70; 446/473, 446/475, 483; 417/523, 529, 531
See application file for complete search history.

(56) References Cited

U.S. PATENT DOCUMENTS

| | | | | | |
|---|---|---|---|---|---|
| 4,630,757 | A | * | 12/1986 | Yano | 222/79 |
| 5,439,139 | A | * | 8/1995 | Brovelli | 222/79 |
| D372,506 | S | * | 8/1996 | Kino | D21/572 |
| 5,622,159 | A | * | 4/1997 | Liu et al. | 222/79 |
| 5,730,325 | A | * | 3/1998 | Cheung | 222/79 |
| 5,829,635 | A | * | 11/1998 | Brovelli | 222/79 |
| 6,067,975 | A | * | 5/2000 | Ginn | 124/65 |

* cited by examiner

*Primary Examiner* — Kevin P Shaver
*Assistant Examiner* — Nicholas J Weiss
(74) *Attorney, Agent, or Firm* — The Marbury Law Group, PLLC

(57) ABSTRACT

A water gun discharges water continuously by pushing in and pulling out an operating portion and has a casing imitating a barrel, a rear grip portion and a front grip portion. The casing incorporates a pump mechanism and includes pumping tubing forming a pumping path through which water is pumped up from a water storage tank by the pumping mechanism and a muzzle portion disposed at a front end of the casing. The pump mechanism includes a first cylinder and a second cylinder which are oriented in opposite directions, a first piston slidable forwards and backwards within the first cylinder and a second piston slidable forwards and backwards within the second cylinder, an interlocking member coupled to the first piston and the second piston and brought into engagement with a rear half portion of the casing, pumping check valves, a jet water flowing chamber and a water supply path.

8 Claims, 6 Drawing Sheets

WATER GUN

CROSS-REFERENCE TO RELATED APPLICATIONS

This application is based upon and claims the benefit of priority under 35 USC 119 of Japanese Patent Application No. 2011-276834 filed on Dec. 19, 2011, the entire disclosure of which, including the description, claims, drawings and abstract, is incorporated herein by reference.

FILED OF THE INVENTION

The present invention relates to a water gun that shoots a jet of water by employing a pump mechanism.

BACKGROUND OF THE INVENTION

There have been heretofore proposed various types of water guns or pistols that shoot a jet of water from water within a tank by employing a pump mechanism. For example, in some water guns, there is a water gun in which water within a cylinder is pressed by a member linked with a trigger so as to be forcibly discharged from a distal end of the water gun by pulling the trigger.

In addition, in a water gun disclosed in Japanese Unexamined Patent Application No. 2005-312473 that is referred to as Patent Literature 1, when a trigger is pulled, a pressure member moves via an engaging member that is linked with the trigger for movement so as to extend an elastic member, and a piston member is caused to move towards a water supply port within a cylinder portion, whereby water within the cylinder portion is discharged into a propelling chamber. Following this, when the trigger reaches a predetermined position, as a series of actions, the engagement of the engaging member with the pressure member is released, the pressure member is caused to move forward as a result of the elastic member so extended being restored, and the water in the propelling chamber is forcibly propelled from a propelling port whose bore diameter is narrowed. The water so propelled is shot in the form of a bullet.

However, in the water gun described in the patent literature described above, a jet of water is shot once every time the trigger is pulled once. Thus, for example, when the water gun is used in a game that is played by shooting as much water as possible to a target or an object like a figure within a predetermined period of time, once a jet of water has been shot, to shoot another jet of water thereafter, the trigger needs to be pulled again after the trigger is returned to the initial position, which causes a problem that a certain length of time needs to be spent for continuous shooting of jets of water.

BRIEF SUMMARY OF THE INVENTION

The invention has been made in view of the problem that is inherent in the related art, and an object thereof is to provide a water gun that can shoot jets of water continuously by pushing and pulling an operating portion.

According the invention, there is provided a water gun comprising: a casing that imitates a gun barrel; a rear grip portion that is formed at a rear end or close to the rear end of the casing; a front grip portion that is formed on a front half portion of the casing; a muzzle portion that is disposed at a front end of the casing; a pump mechanism in the front half portion of the casing which includes a first cylinder and a second cylinder that are oriented in opposite directions in a front-to-rear direction; pumping tubing that forms a pumping path through which water is pumped up from a water storage tank by the pump mechanism; wherein, the casing being configured so that a rear half portion is made slidable relative to the front half portion together with the rear grip portion, and wherein, the pump mechanism comprising: a first piston that is disposed so as to move forwards and backwards within the first cylinder and a second piston that is disposed so as to move forwards and backwards within the second cylinder; an interlocking member that is coupled to the first piston and the second piston and which is brought into engagement with the rear half portion of the casing; pumping check valves that can close respective openings in the cylinders that establish a communication between the cylinders and the pumping tubing; a jet water flowing chamber that is disposed in front of the first cylinder and which has a discharging check valve that can close an opening in a water supply port from the first cylinder so as to allow water to jet from a muzzle of the muzzle portion; and a water supply path that connects the second cylinder with the jet water flowing chamber and which has a discharging check valve that can close a water supply port in the second cylinder.

In addition, in the water gun according to the invention, the rear grip portion is formed into a grip-like shape and the front grip portion is formed into a magazine-like shape, and both the rear grip portion and the front grip portion are provided on the casing so as to project downwards there from.

Further, in the water gun according to the invention, the pumping tubing is formed of a flexible tube.

Additionally, in the water gun according to the invention, the first piston and the second piston are disposed upper and lower, and the pistons press the corresponding cylinders alternately so as to press them in opposite directions within the corresponding cylinders.

According to the invention, it is possible to provide the water gun that can shoot continuously jets of water by pushing and pulling the operating portion.

Further, according to the invention, since the water gun is formed into a shape like a machine gun and has the magazine-shaped grip portion and the grip-shaped grip portion, a child who plays with this water gun can feel the charm of a shooting game when the child discharge the water gun.

In addition, according to the invention, since the pumping tubing is formed of the flexible tube, the pumping tubing is flexible and enables the water gun to be handled freely.

Further, according to the invention, the first piston and the second piston are configured so that water is allowed to jet continuously by pressing the first cylinder and the second cylinder of the pump mechanism alternately.

DETAILED DESCRIPTION OF THE PREFERRED EMBODIMENTS

Figure 1:
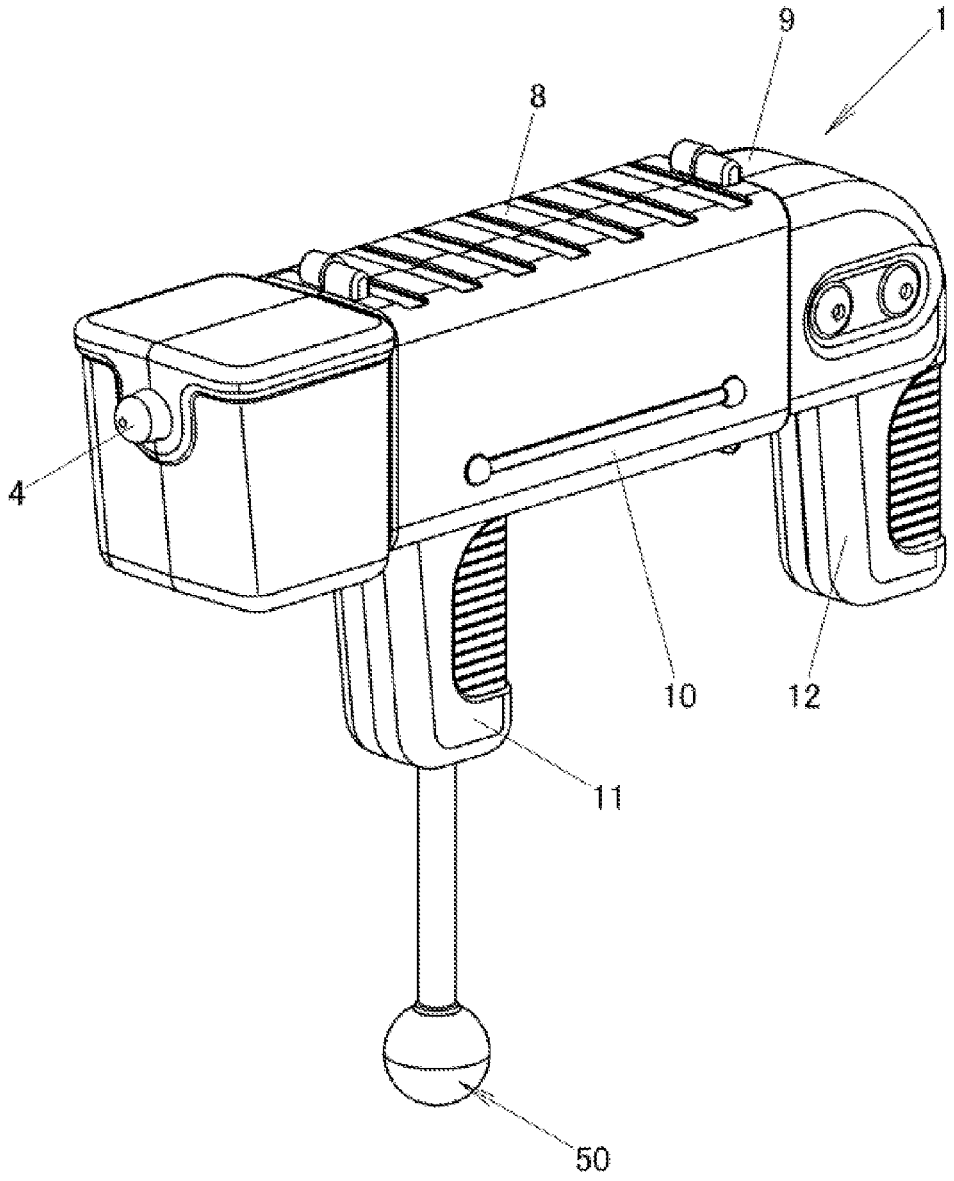
FIG. 1 is an external perspective view of a water gun according to an embodiment of the invention.

A mode for carrying out the invention will be described below. A water gun 1 has a casing 10 that imitates a gun barrel, a rear grip portion 12 that is formed at a rear end or close to the rear end of the casing 10 and a front grip portion 11 that is formed on a front half portion of the casing 10. In addition, the casing 10 is configured so that a rear half portion of the casing 10 can slide forwards and backwards relative to a front half portion of the casing 10 together with the rear grip portion 12. A pump mechanism 40 is incorporated in the front half portion of the casing 10, and this pump mechanism 40 includes a first cylinder 20 and a second cylinder 30 which are oriented in opposite directions in a front-to-rear direction of the casing 10. Additionally, the casing 10 includes pumping tubing 50 which makes up a pumping path 51 through which water is pumped up from a water storage tank by the pump mechanism 40 and a muzzle portion 4 which is disposed at a front end of the casing 10. Then, the pump mechanism 40 includes a first piston 21 which is disposed so as to move forwards and backwards within the first cylinder, a second piston 31 which is disposed so as to move forwards and backwards within the second cylinder, and an interlocking member 25 that is coupled to the first piston 21 and the second piston 31 and which is brought into engagement with the rear half portion of the casing 10. In addition, the pump mechanism 40 includes pumping check valves 41, 42 and, further, a jet water flowing chamber 22 and a water supply path 52. The pumping check valves 41, 42 can close corresponding openings which establish a communication between the cylinders and the pumping tubing 50. The jet water flowing chamber 22 is disposed in front of the first cylinder 20 and has a discharging check valve 45 which can close an opening in a water supply port from the first cylinder 20, thereby allowing water to jet from a muzzle of the muzzle portion 4. The water supply path 52 connects the second cylinder 30 and the jet water flowing chamber 22 and has a discharging check valve 43 which can close a water supply port of the second cylinder 30.

Additionally, in the water gun 1, the rear grip portion 12 is formed into a grip-like shape, and the front grip portion 11 is formed into a magazine-like shape. These grip portions are provided on the casing 10 so as to project downwards there from.

In addition, the pumping tubing 50 is formed of a flexible tube.

Further, the first piston 21 and the second piston 31 are disposed upper and lower and press the corresponding cylinders alternately so as to press the cylinders in opposite directions within the corresponding cylinders.

An embodiment of the invention will be described by reference to the drawings.

Figure 2:
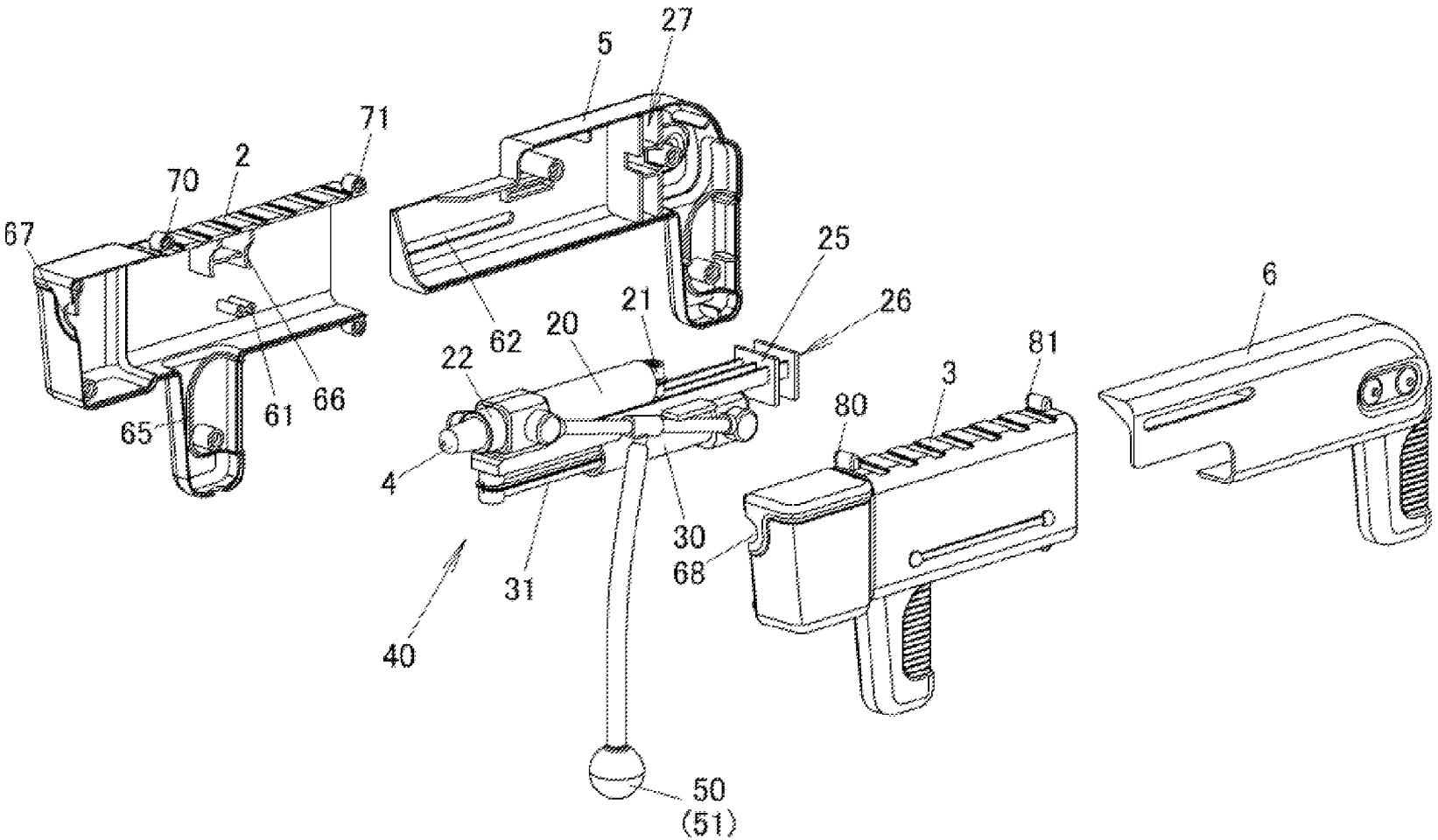
FIG. 2 is an exploded perspective view of the water gun according to the embodiment of the invention.

FIG. 1 is an external perspective view of a water gun 1 according to an embodiment of the invention, and FIG. 2 is an exploded perspective view of the water gun 1 according to the embodiment. In the water gun 1, a side from which a jet of water is forcibly discharged is referred to as a front direction, a side where an operating portion resides is referred to as a rear direction, and left and right sides of the water gun 1 with respect to the front direction in which a jet of water is discharged are referred to as a left direction and a right direction, respectively. Additionally, an upper side and a lower side of the water gun 1 shown in the external perspective view shown in FIG. 1 are referred to as an upward direction and a downward direction, respectively.

The water gun 1 according to the embodiment of the invention has a casing 10 that imitates a gun barrel and a main body of a gun, a rear grip portion 12 that is provided so as to extend downwards from a rear end of the casing 10 and which imitates a grip portion of the gun and a front grip portion 11 that is provided so as to extend downwards from a middle portion of the casing 10 and which imitates a magazine of the gun. A rear half portion of the casing 10 is made into an operating portion 9 which is made to slide forwards and backwards relative to a front half portion of the casing 10.

Additionally, the front half portion of the casing 10 is made into a front casing 8. The front casing 8 has in an interior thereof two cylinders which are a cylinder having a piston room defined in a front portion thereof and a cylinder having a piston room defined in a rear portion thereof The front casing 8 also has in the interior thereof pumping tubing 50 that is formed of a flexible tube and which extends downwards from the front grip portion 11 that imitates a magazine of a gun.

Consequently, the operating portion 9, which is the rear half portion of the casing 10, can be pulled out and pushed in by holding the front grip portion 11 by the left hand, for example, and holding the rear grip portion 12 by the right hand so as to move the operating portion 9 backwards and forwards. Thus, by contracting the piston rooms in the two cylinders in an alternate fashion and keeping a distal end of the pumping tubing 50 submerged in water, water is allowed to jet from a distal end of the casing 10 that imitates the barrel of a gun.

This water gun 1 is formed by coupling together cover members which are formed by dividing a hollow substantially rectangular parallelepiped body vertically and longitudinally with a plurality of screws. As shown in FIG. 1, the water gun 1 is formed into the shape of a machine gun and has the front grip portion 11 and the rear grip portion 12 which imitate a magazine and a grip portion of the machine gun, respectively, as has been described before.

Additionally, the water gun 1 includes the pumping tubing 50 which has the flexible tube that is formed of a resin or a rubber and which makes up a pumping path 51 which is suspended downwards from the front grip portion 11 for pumping up water and a spherical body that is provided at a distal end of the flexible tube and which is partially opened for pumping up water therefrom. This pumping tubing 50 is used to pump up water from a washbasin, a bucket or a bathtub where water is stored by keeping the spherical body at the lower end of the suspended tubing 50 floating in the water so that the water so pumped up is allowed to jet from a front end of the front casing 8. Further, the water gun 1 includes a muzzle portion 4 from which water is caused to jet. The muzzle portion 4 is formed into a substantially conical shape which tapers as it extends forwards by forming an inclined surface at the front end of the front casing 8.

Then, as shown in FIG. 2, the water gun 1 is formed so that a pump mechanism 40 is encompassed in an interior of the cover members which are coupled together.

Specifically speaking, the water gun 1 is made up of a right front cover member 2, a left front cover member 3, a right rear cover member 5 and a left rear cover member 6 that are made of a hard resin and which are coupled together so as to form all side surfaces of the water gun 1. The right front cover member 2 and the left front cover member 3 are fitted on or in each other and are joined together at screw fastening portions 70, 71 of the right front cover member 2 and screw fastening portions 80, 81 of the left front cover member 3.

Additionally, the right rear cover member 5 and the left rear cover member 6 are also joined together at screw fastening portions or joining portions, not shown, which are provided therein with screws.

Further, as to the right front cover member 2 and the right rear cover member 5, the right rear cover member 5 is made to act as the operating portion 9 and is allowed to slide forwards and backwards relative to the right front cover member 2. Namely, two cylindrical engagement projections 61 are provided so as to be aligned in a front-to-rear direction within an interior of the right front cover member 2, while an engagement opening 62 is formed in the right rear cover member 5 so as to extend in the front-to-rear direction into an elliptic shape, and this engagement opening 62 has a width which is substantially equal to the diameter of the engagement projection 61. Then, the engagement projections 61 are inserted through the engagement opening 62 so that distal ends of the engagement projections 61 project into the right rear cover member 5, whereby the operating portion 9 is allowed to slide only forwards and backwards.

In addition, by giving the engagement opening 62 a predetermined length in the front-to-rear direction, a front end position and a rear end position of the right rear cover member 5 are restricted when the right rear cover member 5 is caused to slide relative to the right front cover member 2. Note that the same cover interior configuration is also given to the left front cover member 3 and the left rear cover member 6.

In holding the pump mechanism 40 within the water gun 1, the pump mechanism 40 is supported by openings and ribs which are formed in the cover members while being brought into engagement therewith.

For example, two arc-shaped fixing ribs 66 are formed in the interior of the right front cover member 2 to fix in place a first cylinder 20 of the pump mechanism 40 that is held therein. Similarly, ribs, not shown, are also formed in an interior of the left front cover member 3 to fix in place a second cylinder 30 of the pump mechanism 40 within the casing.

In addition, an accommodating rib 65 is formed in the interior of the right front cover member 2 to accommodate the pumping tubing 50 in a predetermined position in the water gun 1 so as to guide the pumping tubing 50 to a position lying below the front grip portion 11.

Further, semicircular opening portions 67, 68 are formed in front ends of the right front cover member 2 and the left front cover member 3, respectively, from which the muzzle portion 4 that is formed at a front end of the pump mechanism 40 is exposed.

Additionally, an engagement rib 27 is formed in an interior of each of the right rear cover member 5 and the left rear cover member 6 for engagement with a T-shaped engagement portion 26 which is formed at the rear of an interlocking member 25 of the pump mechanism 40. The engagement rib 27 is formed by cutting out individually distal ends of two flat plate-like ribs into a U-like shape.

Figure 3:
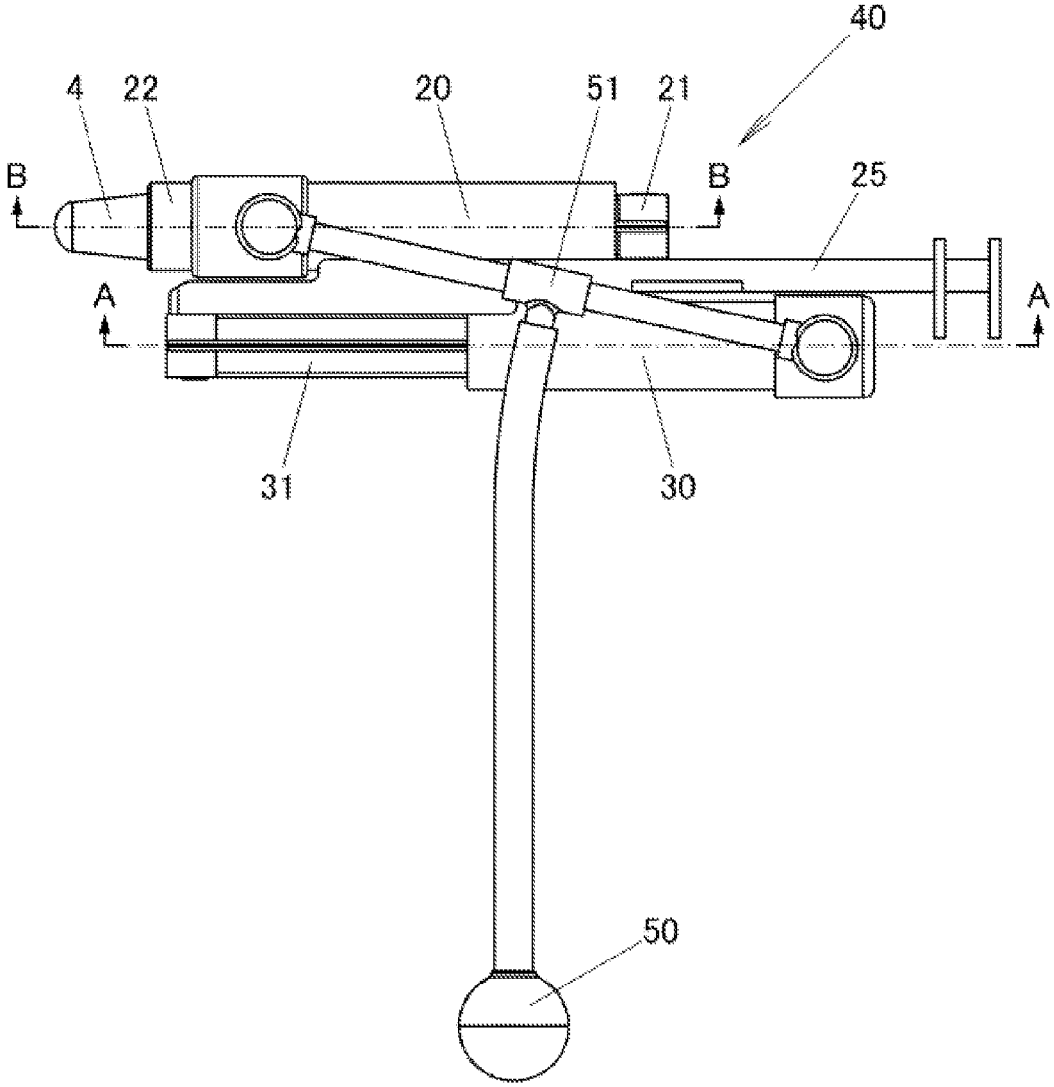
FIG. 3 is a left side view of a main part of a pump mechanism according to the embodiment of the invention.
Figure 4:
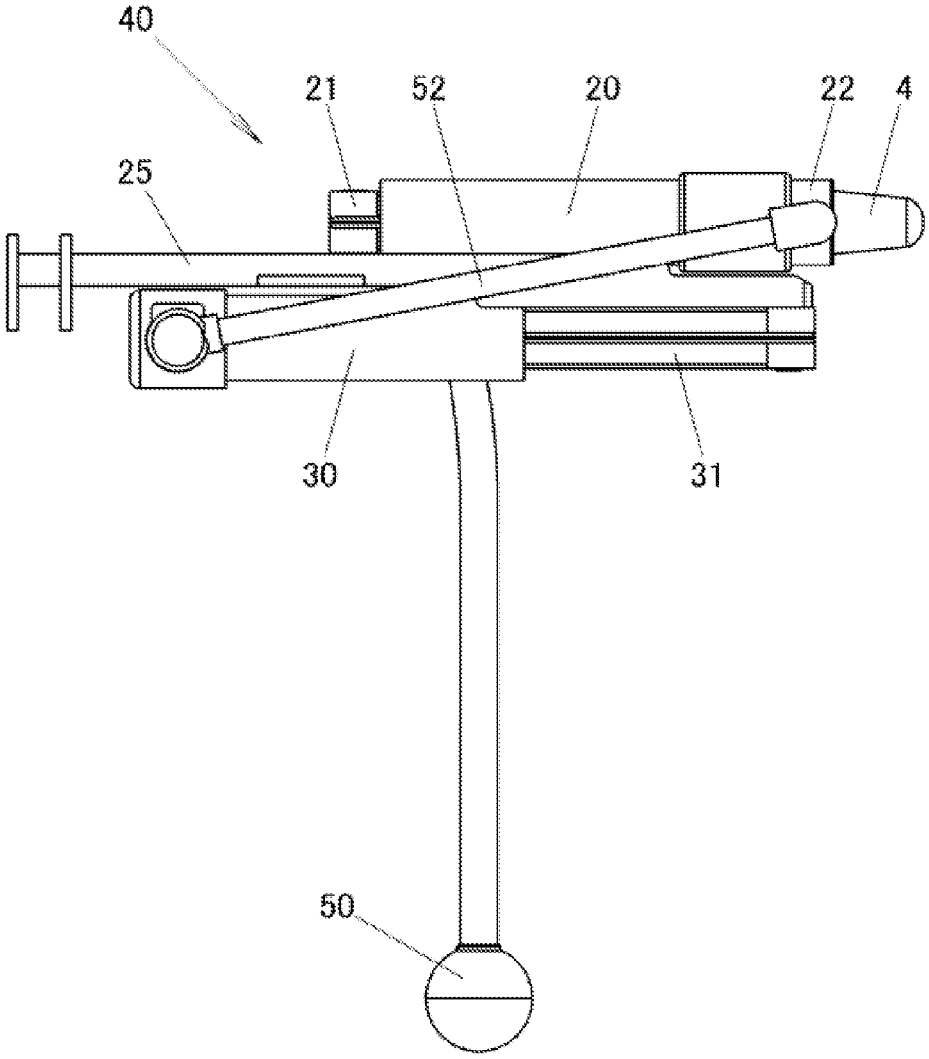
FIG. 4 is a right side view of the main part of the pump mechanism according to the embodiment of the invention.

Next, the pump mechanism 40 will be described in detail. As shown in FIGS. 2 to 4, the pump mechanism 40 includes the first cylinder 20 which is situated in an upper position, a first piston 21 which operates within the first cylinder 20, the second cylinder 30 which is situated in a lower position, a second piston 31 which operates within the second cylinder 30, the interlocking member 25 that is situated in an intermediate position between the first cylinder 20 and the second cylinder 30 and which is connected to the individual pistons, the pumping tubing 50 which makes up a pumping path 51 through which water is pumped up into the first cylinder 20 and the second cylinder 30, and a water supply path 52 through which water is pumped up from the second cylinder 30 to the muzzle portion 4 which is connected to the front of the first cylinder 20.

The first cylinder 20 is made of a hard resin material and is formed into a cylindrical shape. The first cylinder 20 is positioned above and at the front of the interlocking member 25 and is connected to the muzzle portion 4 which is formed into the substantially conical shape at the front thereof. Additionally, the pumping tubing 50 is connected to a left front portion of the first cylinder 20.

The second cylinder 30 is made of a hard resin material and is formed into a cylindrical shape. The second cylinder 30 is positioned below and at the rear of the interlocking member 25. Additionally, the pumping tubing 50 is connected to a left rear portion of the second cylinder 30. In addition, as shown in FIG. 4, the water supply path 52 connects a right rear portion of the second cylinder 30 with the muzzle portion 4 so that water is pushed out from the second cylinder 30 into the muzzle portion 4 by way of the water supply path 52.

The first piston 21 is connected to the interlocking member 25 above the interlocking member 25, and the second piston 31 is connected to the interlocking member 25 below the interlocking member 25. The first piston 21 and the second piston 31 are connected to the interlocking member 25 in such a state that they are oriented in opposite directions and can be pressed in an alternate fashion.

The interlocking member 25 is made of a hard resin material and has a rod-shaped portion that is formed as an integral unit in which three elongated plate materials which are disposed so as to extend in the front-to-rear direction while being erected individually in a vertical direction from one longer side thereof and a single vertical plate material are connected together. In this rod-shaped portion, two rectangular plate materials are coupled integrally to a rear end portion of the rod-shaped portion so that the two plate materials are oriented at right angles to the rod-shaped portion with respect to the front-to-rear direction, whereby the T-shaped engagement portion 26 is formed integral with the rod-shaped portion.

In addition, a pivot is provided on the interlocking member 25 so as to be erected therefrom. This pivot is provided for a piston rod which is situated at the rear of the first piston 21 which is disposed parallel to an upper surface of a front portion of the interlocking member 25. Then, this pivot is press fitted in a hole portion in the piston rod which is situated at the rear of the first piston 21, whereby the interlocking member 25 and the first piston 21 are integrated with each other.

Further, a pivot is also provided on the interlocking member 25 so as to be erected therefrom. This pivot is for a piston rod which is situated at the front of the second piston 31 which is disposed parallel to a lower surface of the front portion of the interlocking member 25. Then, this pivot is press fitted in a hole portion in the piston rod which is situated at the front of the second piston 31, whereby the interlocking member 25 and the second piston 31 are integrated with each other.

Figure 5:
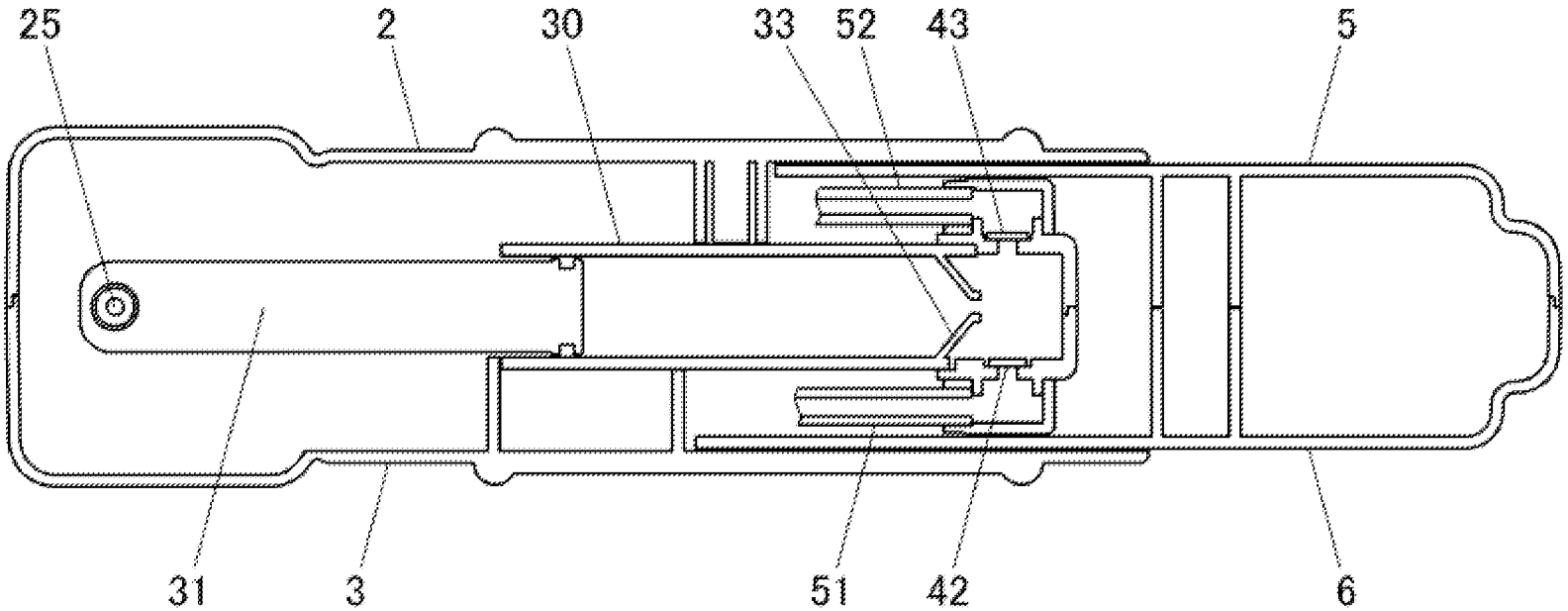
FIG. 5 is a horizontal sectional view of the water gun showing mainly a lower main part of the pump mechanism according to the embodiment of the invention.
Figure 6:
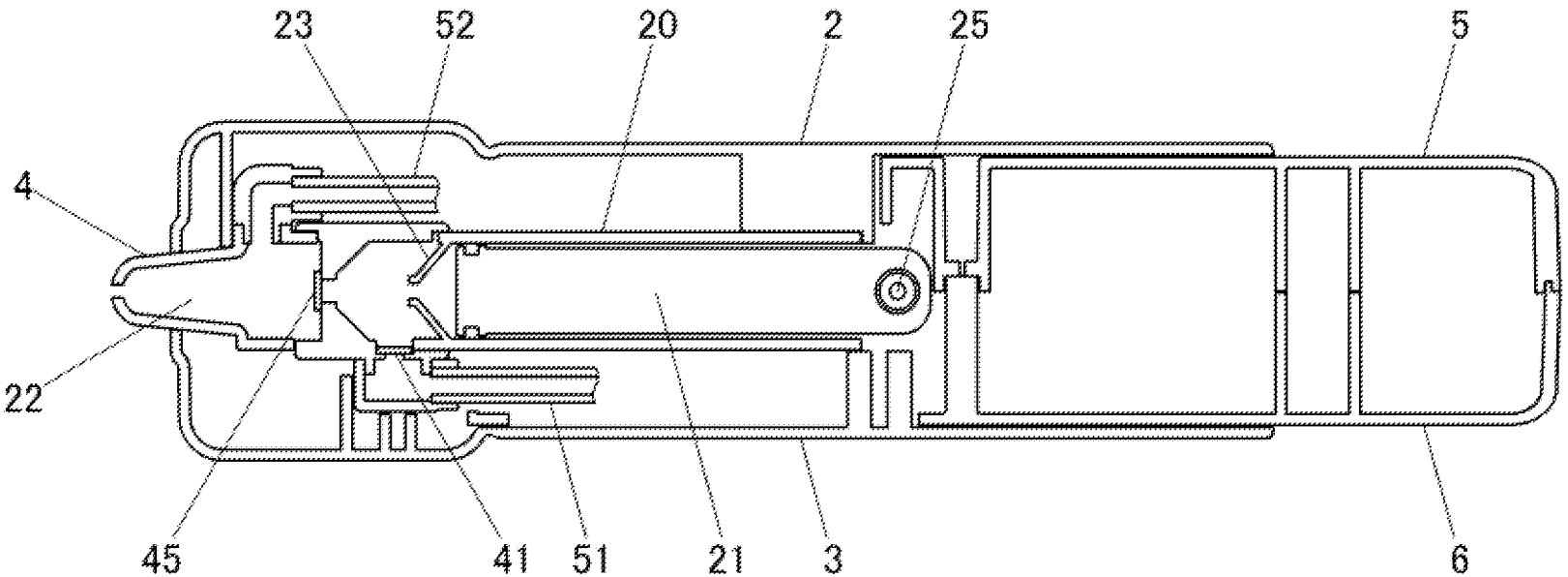
FIG. 6 is a horizontal sectional view showing mainly an upper main part of the pump mechanism according to the embodiment of the invention.

A construction will be described in detail by reference to the drawings in which these two pistons are operated to press water in the corresponding cylinders in an alternate fashion so as to cause the water to jet from the muzzle portion 4 by means of actions of the pistons. FIG. 5 is a horizontal sectional view taken along the plane A-A shown in FIG. 3 which shows a lower main part of the pump mechanism 40, including the cover members. FIG. 6 is a horizontal sectional view taken along the plane B-B shown in FIG. 3 which shows an upper main part of the pump mechanism 40, including the cover members.

As shown in FIG. 5, the pumping path 51 which communicates with the pumping tubing 50 is connected to a left rear portion of the second cylinder 30 which is disposed below the first cylinder 20 and the water supply path 52 is connected to a right rear portion thereof. Thus, the pumping path 51 and the water supply path 52 are connected to the positions on the second cylinder 30 which are situated symmetrically with respect to an axis of the cylinder 30. Additionally, a pumping check valve 42 and a discharging check valve 43 are incorporated in interiors of connecting portions between the respective paths and the second cylinder 30.

Additionally, a water supply opening portion 33 is provided near the pumping check valve 42 and the discharging check valve 43 in an interior of the second cylinder 30. This water supply opening portion 33 is opened at a distal end thereof and is formed into a hollow conical shape, whereby a flow of water is restricted. By providing the water supply opening portion 33, the flow of water is restricted, exhibiting a resistance against the operation of the piston, thereby making it possible to impart a predetermined resistance as the operating properties of the water gun 1 when the piston is pushed in or pulled out.

The pumping check valve 42 is made up of a circular rubber or resin material and has a diameter which is larger than a bore diameter of a hole portion which is opened in a wall surface of the second cylinder 30 so that the pumping check valve 42 is disposed thereat. Thus, the pumping check vale 42 is made to open its valve element toward an inside of the cylinder 30 which is a side where water pumped up by way of the pumping path 51 by pulling out the second piston 31 for suction of water is allowed to enter the interior of the cylinder 30. Additionally, when water stored within the second cylinder 30 is pressed by the second piston 31 to thereby be supplied towards the water supply opening portion 33 and is then discharged into the water supply path 52 by way of the discharging check valve 43, which will be described later, to thereby be supplied into a jet water flowing chamber 22, the pumping check valve 42 is held in a closed state.

The discharging check valve 43 is also made up of a circular rubber or resin material and has a diameter which is larger than a bore diameter of a hole portion which is opened in a wall surface of the second cylinder 30 so that the discharging check valve 43 is disposed thereat. Thus, the discharging check vale 43 is made to open its valve element toward an outside of the cylinder 30 which is a side where water is supplied into the jet water flowing chamber 22 within the muzzle portion 4 by way of the water supply path 52 when the second piston 31 is pushed in for pressing water stored in the second cylinder 30. Additionally, when water is pumped up into the second cylinder 31 by way of the pumping path 51 by the second piston 31 which is pulled out for suction of water, the first piston 21 is pushed in as a result of the pistons being pressed in an alternate fashion, and a pressure is applied to the discharging check valve 43 by way of the water supply path 52 in a direction in which the discharging check valve 43 closes its valve element.

As shown in FIG. 6, the muzzle portion 4 is integrated with a front end of the first cylinder 20. A muzzle is formed in a front end of the muzzle portion 4 and the jet water flowing chamber 22 is formed in an interior of the muzzle portion 4. Additionally, the water supply path 52 is connected to a right-hand side of the jet water flowing chamber 22. Then, a discharging check valve 45 is provided at a portion through which water is supplied from the first cylinder 20 into the jet water flowing chamber 22.

Additionally, the pumping path 51 which communicates with the pumping tubing 50 is connected to a left front portion of the first cylinder 20. A pumping check valve 41 is incorporated in an interior of the first cylinder 20 in a position where the pumping path 51 is connected to the first cylinder 20.

In addition, a water supply opening portion 23 is provided near the pumping check valve 41 in the interior of the first cylinder 20. This a water supply opening portion 23 is opened at a distal end thereof and has a hollow conical shape. Thus, the water supply opening portion 23 restricts a flow of water. By providing the water supply opening portion 23, the flow of water is restricted, exhibiting a resistance against the operation of the piston, thereby making it possible to impart a predetermined resistance as the operating properties of the water gun 1 when the piston is pushed in or pulled out.

The pumping check valve 41 is made up of a circular rubber or resin material and has a diameter which is larger than a bore diameter of a hole portion which is opened in a wall surface of the first cylinder 20 so that the pumping check valve 41 is disposed thereat. Thus, the pumping check vale 41 is made to open its valve element toward an inside of the cylinder 20 which is a side where water pumped up by way of the pumping path 51 by pulling out the first piston 21 for suction of water is allowed to enter the interior of the cylinder 20. Additionally, when water stored within the first cylinder 20 is pressed by the first piston 21 to thereby be supplied towards the water supply opening portion 23 and is then supplied into the jet water flowing chamber 22, the pumping check valve 41 is held in a closed state.

The discharging check valve 45 is also made up of a circular rubber or resin material and has a diameter which is larger than a bore diameter of a hole portion where the discharging check valve 45 is disposed and through which water is supplied from the first cylinder 20 into the jet water flowing chamber 22. Thus, the discharging check vale 45 is made to open its valve element when the first piston 21 is pushed in to press water within the first cylinder 20. Additionally, when water is pumped up into the first cylinder 21 by way of the water supply path 52 by the second piston 31 which is pushed in for pressing water within the second cylinder 30, the first piston 21 is pulled out as a result of the pistons being pressed in an alternate fashion, and a pressure is applied to the discharging check valve 45 in a direction in which the discharging check valve 45 closes its valve element.

An operation will be described in detail in which these two pistons are operated to press water within the corresponding cylinders in an alternate fashion so that water in the cylinders is allowed to jet from the muzzle portion 4 in an alternate fashion by the actions of the pistons.

In the pump mechanism 40, when the operating portion 9 is pushed in to the front from the rear thereof, the second piston 30 is moved to the front so as to expand a space within the second cylinder 30 of the pump mechanism 40 for suction of water thereinto as shown in FIG. 5, whereby water is pumped up from the water storage tank into the expanded space in the second cylinder 30 by way of the pumping path 51 that is connected to the rear of the second cylinder 30. Then, the resin or rubber pumping check valve 42 is opened, whereby water is stored within the second cylinder 30.

Then, when the operating portion 9 is being pushed in to the front from the rear thereof, the first piston 21 is moved to the front in association with the forward movement of the second piston 31, whereby water is stored within the second cylinder 30, and at the same time, the first piston 21 compresses a space within the first cylinder 20 which is positioned upper in the pump mechanism 40 so as to narrow the space while pressing the corresponding cylinder 20. This opens the resin or rubber discharging check valve 45 shown in FIG. 6, so that water that has already been stored in the first cylinder 20 which is referred to as a first storage tank is discharged into the jet water flowing chamber 22, allowing the water so flowing into the jet water flowing chamber 22 to jet from the muzzle portion 4.

Additionally, when the operating portion 9 is pulled out from its front position towards the rear, the first piston 21 is moved to the rear so as to expand the space within the first cylinder 20 of the pump mechanism 40 for suction of water thereinto, whereby water is pumped up from the water storage tank by way of the pumping path 51. Then, the resin or rubber pumping check valve 41 shown in FIG. 6 is opened so as to allow water to be taken into the first cylinder 20 which is referred to as the first storage tank for storage therein.

Further, when the operating portion 9 is being pulled out from its front position to the rear, water is stored within the first cylinder 20, and at the same time, the second piston 31 presses the corresponding second cylinder 30 so as to narrow the space within the second cylinder 30 which is positioned lower in the pump mechanism 40. This opens the resin or rubber discharging check valve 43 shown in FIG. 5, so that water that has already been stored within the second cylinder 30 which is referred to as a second storage tank is pumped up by way of the water supply path 52 which connects the second cylinder 30 with the muzzle portion 4 so as to be discharged into the jet water flowing chamber 22, allowing the water so flowing into the jet water flowing chamber 22 to jet from the muzzle portion 4.

Additionally, in this pump mechanism 40, the second cylinder 30 and the first cylinder 20 are aligned so as to be situated substantially in such a position as a front end of the second piston 31 being aligned with the front end of the first cylinder 20 when the second piston 31 in the second cylinder 30 in which the piston room is defined in the rear portion is advanced as shown in FIGS. 3 and 4. Additionally, in the pump mechanism 40, the second cylinder 30 and the first cylinder 20 are used which have the same size and the substantially identical construction. Therefore, although not shown, the second cylinder 30 and the first cylinder 20 are situated substantially in such a position as a rear end of the first piston 21 being aligned with a rear end of the second cylinder 30 when the first piston 21 of the first cylinder 20 is withdrawn.

Consequently, an operating range of the rear end of the first piston 21 is made to fall within a range defined by a longitudinal length of the second cylinder 30, while an operating range of the rear end of the second piston 31 is made to fall within a range defined by a longitudinal length of the first cylinder 20. Thus, it is possible to allow a large quantity of water to jet from the water gun 1 without increasing an overall length of the pump mechanism 40 and hence with the water gun 1 kept small in size by reducing the length of the water gun 1.

Further, since the first cylinder 20 and the second cylinder 30 which have the same size are used, bore diameters of the first cylinder 20 and the second cylinder 30 are the same. Thus, a quantity of water that is allowed to jet from the muzzle portion 4 when the operating portion 9 is moved to the front becomes the same as a quantity of water that is allowed to jet from the muzzle portion 4 when the operating portion 9 is moved to the rear, and therefore, there exists no difference in quantity of water to jet from the muzzle portion 4 between when the operating portion 9 is moved to the front and when the operating portion 9 is moved to the rear, whereby the user can play with the water gun 1 without uncomfortable feeling when the player operates the operating portion 9.

In the description that has been made heretofore, while the pump mechanism 40 is described as being configured so that the first cylinder 20 which is positioned upper and the second cylinder 30 which is positioned lower are pressed in the alternate fashion, the invention is not limited thereto. For example, there may be a configuration in which the first cylinder 20 and the second cylinder 30 are disposed parallel in a horizontal direction. Additionally, there will be no problem even in the event that a configuration is added in which the first cylinder 20 and the second cylinder 30 are disposed so that they are oriented in the same position with respect to the front-to-rear direction and are pressed in an alternate fashion.

Additionally, while the water gun 1 of this embodiment is formed into the machine gun, the invention is not limited thereto. For example, there will be no problem even in the event that the invention is applied to a form in which the water gun 1 takes the shape of a rifle which is held by both hands as an external appearance.

Thus, as has been described heretofore, according to the embodiment of the invention, it is possible to provide the water gun 1 which allows water to jet therefrom with the operating portion 9 being pushed in and pulled out.

Further, according to the invention, since the water gun 1 is formed into a machine gun and has the magazine-shaped grip portion and the grip-shaped grip portion, a child who plays with this water gun can feel the charm of a shooting game when the child discharge the water gun.

In addition, since the pumping tubing 50 forming the pumping path 51 is formed of the flexible tube, the pumping tubing 50 has flexibility and hence can be handled freely.

Further, the first piston 21 and the second piston 31 are made to press alternately the first cylinder 20 and the second cylinder 30 of the pump mechanism 40 within the first cylinder 20 and the second cylinder 30 in the pump mechanism 40, whereby it is possible for water to jet from the water gun 1.

While the embodiment of the invention has been described, the embodiment has been described as the example of the invention and hence, there is no intention to limit the scope of the invention by the embodiment described. This novel embodiment can be made in various forms, and various omissions, replacements or alterations can be made to the embodiment without departing from the spirit and scope of the invention. This embodiment and modifications made thereto are included not only in the spirit and scope of the invention but also in the scope of claims and their equivalents.

What is claimed is:

1. A water gun comprising:

a casing that imitates a gun barrel;

a rear grip portion that is formed at a rear end or close to the rear end of the casing;

a front grip portion that is formed on a front half portion of the casing;

a muzzle portion that is disposed at a front end of the casing;

a pump mechanism in the front half portion of the casing which includes a first cylinder and a second cylinder that are oriented in opposite directions in a front-to-rear direction;

pumping tubing that forms a pumping path through which water is pumped up from a water storage tank by the pump mechanism;

wherein, the casing being configured so that a rear half portion is made slidable relative to the front half portion together with the rear grip portion, and wherein, the pump mechanism comprising:

a first piston that is disposed so as to move forwards and backwards within the first cylinder and a second piston that is disposed so as to move forwards and backwards within the second cylinder;

an interlocking member that is coupled to the first piston and the second piston and which is brought into engagement with the rear half portion of the casing;

pumping check valves that open or close respective openings in the cylinders that establish a communication between the cylinders and the pumping tubing;

a jet water flowing chamber that is disposed in front of the first cylinder and which has a discharging check valve that open or close an opening in a water supply port from the first cylinder so as to allow water to jet from a muzzle of the muzzle portion; and a water supply path that connects the second cylinder with the jet water flowing chamber and which has a discharging check valve that open or close a water supply port in the second cylinder.

2. A water gun as set forth in claim 1, wherein the rear grip portion is formed into a grip-like shape and the front grip portion is formed into a magazine-like shape, both the rear grip portion and the front grip portion being provided on the casing so as to project downwards therefrom.

3. A water gun as set forth in claim 1, wherein the pumping tubing is formed of a flexible tube.

4. A water gun as set forth in claim 2, wherein the pumping tubing is formed of a flexible tube.

5. A water gun as set forth in claim 1, wherein the first piston and the second piston are disposed upper and lower, and the first and second pistons press the first and second cylinders in an alternate fashion so as to press the pistons in opposite directions within the corresponding cylinders.

6. A water gun as set forth in claim 2, wherein the first piston and the second piston are disposed upper and lower, and the first and second pistons press the first and second cylinders in an alternate fashion so as to press the pistons in opposite directions within the corresponding cylinders.

7. A water gun as set forth in claim 3, wherein the first piston and the second piston are disposed upper and lower, and the first and second pistons press the first and second cylinders in an alternate fashion so as to press the pistons in opposite directions within the corresponding cylinders.

8. A water gun as set forth in claim 4, wherein the first piston and the second piston are disposed upper and lower, and the first and second pistons press the first and second cylinders in an alternate fashion so as to press the pistons in opposite directions within the corresponding cylinders.

* * * * *